United States Patent [19]

Fender

[11] Patent Number: 4,517,874

[45] Date of Patent: May 21, 1985

[54] STRING LOCK MECHANISM FOR MUSICAL INSTRUMENTS

[76] Inventor: C. Leo Fender, 1510 Dana Pl., Fullerton, Calif. 92635

[21] Appl. No.: 622,068

[22] Filed: Jun. 19, 1984

[51] Int. Cl.[3] ..... G10D 3/12

[52] U.S. Cl. ..... 84/314 N; 84/214

[58] Field of Search ..... 84/214, 293, 297 R, 84/313, 314

[56] References Cited

U.S. PATENT DOCUMENTS

| | | | |
|---|---|---|---|
| 509,414 | 11/1893 | Weber | 84/214 |
| 4,074,606 | 2/1978 | Fender | 84/293 |
| 4,171,661 | 10/1979 | Rose | 84/314 N |
| 4,457,201 | 7/1984 | Storey | 84/313 |
| 4,475,432 | 10/1984 | Stroh | 84/314 N |

*Primary Examiner*—Lawrence R. Franklin

*Attorney, Agent, or Firm*—Spensley Horn Jubas & Lubitz

[57] ABSTRACT

An electric guitar is provided with a string clamping mechanism comprised of a planar base plate and one or more planar top members for clamping the strings between the base plate and top members. The clamp is secured to the guitar on an inclined surface between the top of the neck and the head of the guitar and is of shallow design to avoid interference with the playing of the guitar. A separate nut is provided which may be filed to achieve the desired string clearance at the first fret. The configuration of the clamp is such that the strings will provide a force which tilts the top members forward and down at the front edge to provide improved clamping action. The simple design facilitates the provision of truss rod adjustment at the top of the neck of the guitar.

5 Claims, 5 Drawing Figures

STRING LOCK MECHANISM FOR MUSICAL INSTRUMENTS

BACKGROUND OF THE INVENTION

1. Field of the Invention

The present invention relates to a string lock mechanism for locking the strings of a musical instrument at a predetermined location, and more particularly to a string lock mechanism for locking the strings of an electric guitar at the nut of the guitar.

2. Description of the Prior Art

It has become quite popular to provide electric guitars with a vibrator mechanism for varying string tension for achieving tremolo effects. One problem with such mechanisms is that the strings do not always return to proper pitch with release of the vibrato. This is caused by the friction of the strings sliding over the nut (the ridge over which the strings pass at the top of the neck of the guitar). In order to eliminate this problem, devices have been developed for clamping the strings at the nut to eliminate any possibility of the strings sliding.

Prior art string clamps have several disadvantages associated with them. Some of these devices are relatively cumbersome and can interfere with the playing of the guitar. In addition, the clamp has been made integral with the nut and the resultant assembly has lacked the feature of enabling the nut to be filed to achieve the desired clearance between the strings and the first fret of the guitar. Furthermore, many guitars are provided with an adjustable truss rod assembly running the length of the neck for controllng the curvature of the neck. The adjustment means for the truss rod is preferably provided just back of the nut on the head of the guitar, and bulky string clamp devices can obstruct the adjustment mechanism.

SUMMARY OF THE INVENTION

The present invention is directed to a string clamp assembly which does not interfere with the playing of the guitar, facilitates nut filing so as to enable the proper string clearance to be achieved at the first fret, and facilitates truss rod adjustment at the head of the guitar. The guitar includes a nut assembly at the top of the neck and a separate string clamp positioned on an inclined surface which couples the head to the neck. The string clamp includes a planar base plate which is secured to the inclined surface by a pair of screws, and one or more planar top members secured to the base plate. The strings are clamped between the base plate and top members to secure the strings with respect to the nut. In order to provide good clamping action, the strings enter the clamp from the string posts from an angle above the plane of the portion of the strings passing through the clamp. As a result, the strings provide a force which tends to tilt the top members down into contact with the base member at the edge of the clamp facing the nut.

By placing the clamp on the inclined surface and forming it of relatively thin planar members, the clamp will not interfere with the playing of the guitar. In addition, the simple structure facilitates the provision of a truss rod adjustment mechanism at the head of the guitar. Finally, by providing separate clamp and nut assemblies, the nut can easily be filed to obtain the desired string clearance at the first fret while maintaining proper clamping action.

BRIEF DESCRIPTION OF THE DRAWINGS

The invention will now be described with reference to the accompanying drawings, wherein.

DESCRIPTION OF THE PREFERRED EMBODIMENT

The following description is of the best presently contemplated mode of carrying out the invention. This description is made for the purpose of illustrating the general principles of the invention and is not to be taken in a limiting sense. The scope of the invention is best determined by the appended claims.

Figure 1:
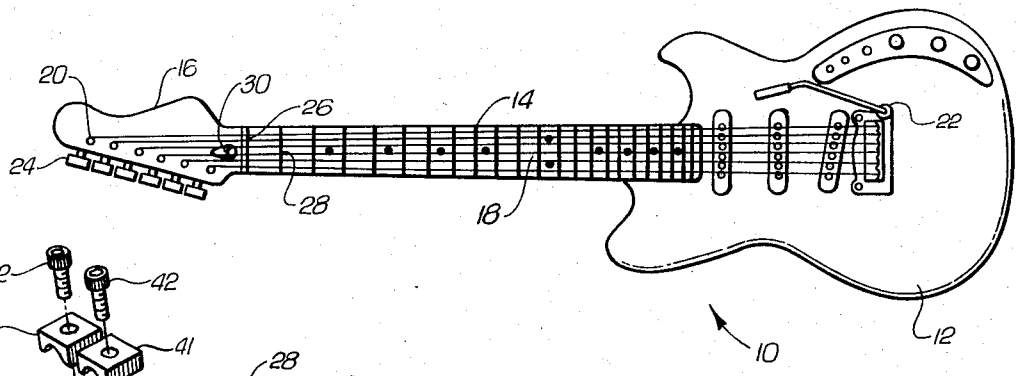
FIG. 1 is a plan view of a guitar without any clamping mechanism.

Referring to FIG. 1, an electric guitar 10 includes a body 12, a neck 14 and head 16. Strings 18 are connected between string posts 20 and a vibrato mechanism and tail piece 22. Tuning of the strings is accomplished by means of tuning knobs 24 which rotate the string posts 20. The strings pass over a nut 26 at the top of the neck. The nut includes a plurality of grooves which are filed to achieve the desired string clearance at the first fret 28. Typically, the nut 26 is formed of melamine or similar material. The guitar also includes a truss rod adjustment shank 30 just above the nut 26. The adjustment shank 30 is provided to adjust the tension of a truss rod which runs the length of the neck 14 to control the curvature of the neck 14.

Figure 2:
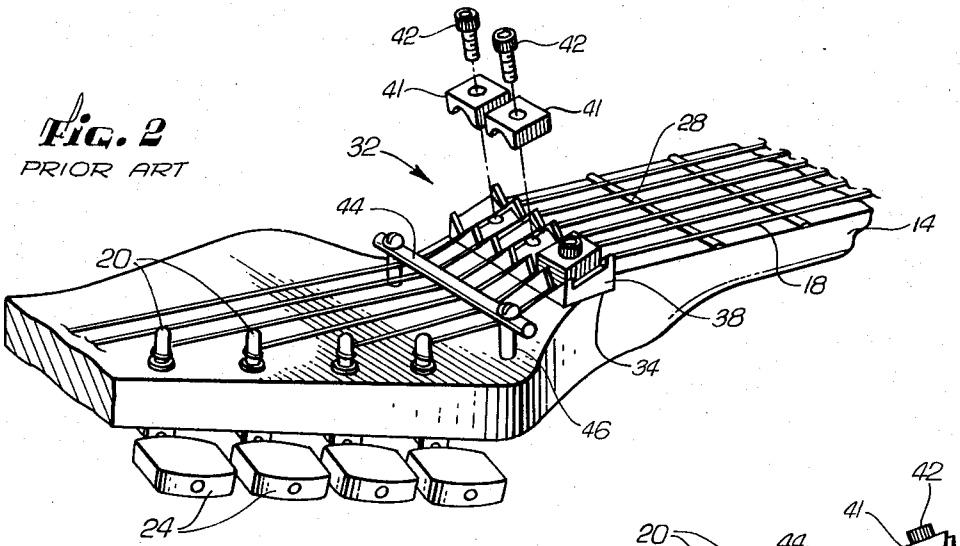
Fig. 2 PRIOR ART
FIG. 2 is a perspective view of the top of the neck and head of a guitar showing a prior art clamping mechanism.
Figure 3:
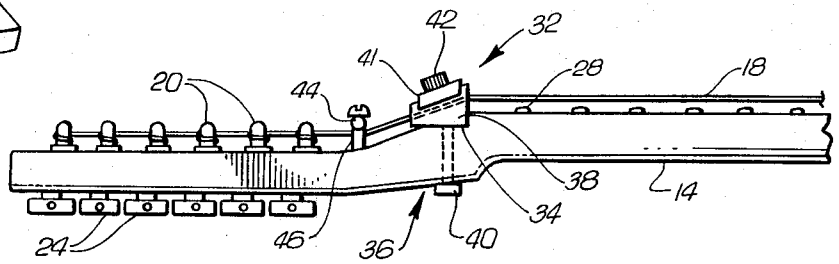
Fig. 3 PRIOR ART
FIG. 3 is a side view of the top of the neck and head of a guitar showing the prior art design.

Referring to FIGS. 2 and 3, a prior art combined nut/string clamp 32 is positioned on a flat surface 34 which is cut out from an inclined section 36 which connects the neck and head of the guitar. The nut/-string clamp 32 includes a base bracket 38 having a plurality of slanted V-grooves formed on its upper surface, with one string being positioned in each V-groove. The base bracket is secured to the guitar by means of a pair of bolts 40 which pass from the bottom to the top of the neck. Three V-shaped clamp members 41 are secured to the bracket 38 by means of bolts 42 and serve to clamp the strings in the grooves of the bracket. The strings pass underneath a bar 44 of a head bracket 46 and then extend substantially horizontally to the string posts 20.

The design shown in FIGS. 2 and 3 has several disadvantages associated with it. Since the nut and clamp are an integral unit, the clamp mechanism extends relatively high over the strings and can interfere with the playing of the guitar. In addition, the design does not facilitate adjustment of the clearance of the strings 18 at the first fret 28. Also, the size of the clamp and the use of the associated bracket 46 effectively precludes the provision of a truss rod adjustment at the head of the guitar. As a result, truss rod adjustment must be provided near the guitar pick-up at the base of the neck, where it is relatively inaccessible and thus inconvenient to use.

Figure 4:
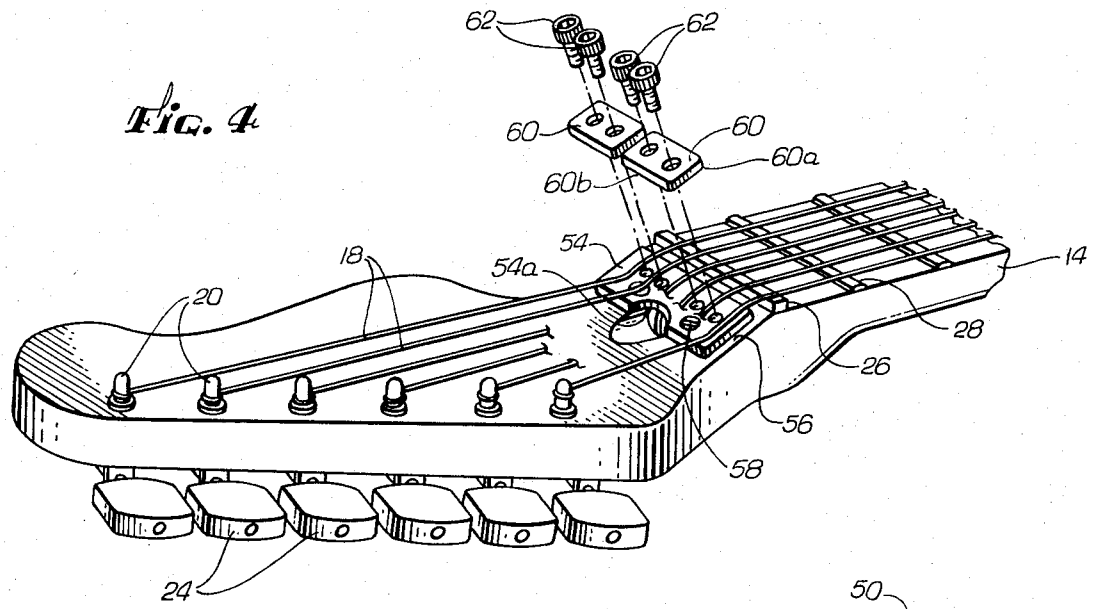
FIG. 4 is a perspective view of the top of the neck and head of a guitar showing the string clamp of the present invention in an exploded configuration.
Figure 5:
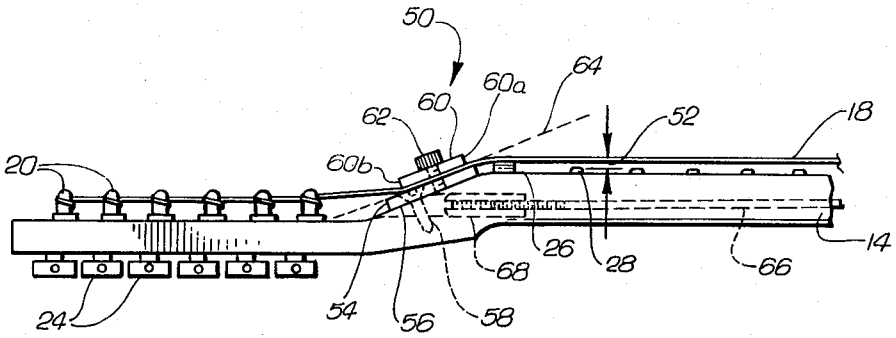
FIG. 5 is a side view of the top of the neck and head of a guitar showing the clamp of the present invention.

Referring now to FIGS. 4 and 5, the present invention is directed to a guitar having a separate nut 26 and string clamp 50. The nut 26 is a standard melamine nut which can be filed to achieve the desired string clearance at the first fret 28 as indicated at 52. The string clamp is comprised of a planar base section 54 which is secured to the inclined surface 56 at the top of the neck by means of a pair of wood screws 58. The strings 18 pass over the base plate 54 and are clamped in position by a pair of planar top members 60. Each of the top members 60 is held in position by a pair of Allen bolts 62. The Allen bolts 62 are positioned substantially in the middle of the top members 60, i.e., halfway between the front and rear edges 60*a* and 60*b*.

The strings 18 are clamped in a plane 64 between the base plate 54 and the top members 60. As can be seen in FIG. 5, the strings enter the clamp at the rear edge 60*b* of the top members at an angle above the plane 64. The tension of the strings 18 causes the top members 60 to be tilted forward and down at the front edge 60*a*. The configuration provides secure clamping of the strings very close to the nut 26. In addition, the shallowness of the design coupled with the fact that the clamp is positioned on the downwardly inclined surface results in a clamping system which does not interfere with the playing of the guitar.

In addition to the facilitation of nut filing, shallow design and secure clamping function of the present invention, the simple plate structure facilitates the provision of truss rod adjustment at the head of the guitar. As shown in FIG. 5, a truss rod 66 pass through the neck 14 and has an adjustment shank 68 at the end thereof. The base plate 54 has a cutout portion 54*a* (FIG. 4), and an adjusting wrench may be easily inserted in an opening in the neck below the clamp assembly to adjust the tension of the truss rod 66. Thus, the present invention provides for nut filing and truss rod adjustment at the top of the neck while providing secure clamping and a shallow design to avoid interference with the playing of the guitar.

What is claimed is:

1. A guitar comprising:

a body;

a neck extending from the body;

a head coupled to the neck, said head and neck having substantially parallel offset planar faces coupled to one another by means of an inclined surface;

a plurality of string posts secured to the head;

a plurality of strings connected to the string posts and extending along the neck over the face thereof to the body;

a nut located at the end of the neck adjacent the head, said nut supporting the strings above the face of the neck; and a string clamp secured to said inclined surface for preventing the strings from sliding with respect to the nut, said string clamp including a planar base plate secured to the inclined surface, at least one planar top member positioned over the base plate and at least one fastener for securing the top member to the base plate, wherein the strings pass between the base plate and top member and are clamped thereby.

2. A guitar as in claim 1 wherein the portion of the strings between the string posts and clamp extend above the plane of the portion of the strings between the base plate and top member thereby to tilt the top member to force the edge thereof nearest the neck downward to positively seat the strings on the nut.

3. A guitar as in claim 1 wherein the nut includes a plurality of grooves for receiving the strings, wherein said nut is made of a material which may be filed to control the clearance of the strings at a predetermined point along the neck.

4. A guitar as in claim 1 including a truss bar running through the neck and having an adjustment element exposed at said slanted surface, said string clamp clamping the strings while maintaining access to the adjustment element.

5. A guitar comprising:

a body;

a neck extending from the body;

a head coupled to the neck, said head and neck having substantially parallel offset planar faces coupled to one another by means of an inclined surface;

a plurality of string posts secured to the head;

a plurality of strings connected to the string posts and extending along the neck over the face thereof to the body;

a nut located at the end of the neck adjacent the head, said nut supporting the strings above the face of the neck; and a string clamp secured to said inclined surface for preventing the strings from sliding with respect to the nut, said string clamp including a flat base plate, at least one screw passing through the base plate and into the inclined surface to secure the base plate to the inclined surface, first and second flat top plates positioned over the base plate, and a pair of bolts securing each top plate to the base plate, said top plates having a front edge facing the neck and a rear edge facing the head, wherein the strings pass between the base plate and top plates and wherein the portion of the strings between the string posts and clamp extend above the plane defined by a portion of the strings between the base plate and top plates thereby to lift the rear edge of the top plates and force the front edge down to securely clamp the strings at the nut.

* * * * *